US008413298B2

(12) United States Patent
Domenig et al.

(10) Patent No.: US 8,413,298 B2
(45) Date of Patent: Apr. 9, 2013

(54) UNIVERSAL DAMPING MECHANISM

(75) Inventors: Georg Domenig, Kernersville, NC (US); Jeffery Morgan, High Point, NC (US); Marte Yerkins, Cleveland, NC (US); Manfred Peer, Walkertown, NC (US)

(73) Assignee: Grass America, Inc., Kernersville, NC (US)

( * ) Notice: Subject to any disclaimer, the term of this patent is extended or adjusted under 35 U.S.C. 154(b) by 0 days.

(21) Appl. No.: 12/741,856

(22) PCT Filed: Jan. 15, 2009

(86) PCT No.: PCT/US2009/031069

§ 371 (c)(1),
(2), (4) Date: May 7, 2010

(87) PCT Pub. No.: WO2009/094284

PCT Pub. Date: Jul. 30, 2009

(65) Prior Publication Data

US 2011/0094055 A1 Apr. 28, 2011

Related U.S. Application Data

(60) Provisional application No. 61/022,579, filed on Jan. 22, 2008.

(51) Int. Cl.
*E05F 5/06* (2006.01)

(52) U.S. Cl. ..... 16/85; 16/DIG. 10

(58) Field of Classification Search ..... 16/82, 85, 16/86 R, 86 A, 83, DIG. 10; 292/DIG. 15, 292/DIG. 19

See application file for complete search history.

(56) References Cited

U.S. PATENT DOCUMENTS 1,700,086 A * 1/1929 Sherwood ..... 16/85
1,816,024 A 7/1931 Petersen (Continued)

FOREIGN PATENT DOCUMENTS

JP 2006/169777 A 6/2006

OTHER PUBLICATIONS

Korean Office Action, Notice of Preliminary Rejection, Korean Patent Application No. 10-2010-7015923, dated Sep. 6, 2012, (6 pages).

(Continued)

*Primary Examiner* — William L. Miller
(74) *Attorney, Agent, or Firm* — Burr & Brown

(57) ABSTRACT

A universal damping mechanism is provided, including a housing having a mounting surface for fixing the housing to an appropriate furniture or fixture surface. The mounting surface includes a bottom surface of a box-shaped portion of the housing, which further includes a pair of laterally opposed side surfaces extending upwardly from the bottom surface. Each lateral side surface includes a recessed portion defining a first opening of an angled hole communicating with a second opening of the angled hole provided in the bottom surface proximate a central portion thereof. A shock absorber subassembly is slidably positioned within a shock absorber receiving portion of the housing and has a first end extending from a first end of the housing, and an adjustment mechanism is coupled to a second end of the housing and adjustably engaged with a second end of the shock absorber subassembly within the shock absorber receiving portion.

20 Claims, 9 Drawing Sheets

U.S. PATENT DOCUMENTS

| | | | | |
|---|---|---|---|---|
| 2,449,686 | A * | 9/1948 | Brinda | 16/85 |
| 3,805,306 | A | 4/1974 | Stairs | |
| 6,408,483 | B1 | 6/2002 | Salice | |
| 6,629,738 | B2 | 10/2003 | Salice | |
| 6,846,053 | B2 | 1/2005 | Salice | |
| 7,076,834 | B2 * | 7/2006 | Li | 16/85 |
| 2004/0181903 | A1 | 9/2004 | Salice | |
| 2006/0220284 | A1 | 10/2006 | Holzapfel | |
| 2007/0012831 | A1 | 1/2007 | Perron | |

OTHER PUBLICATIONS

Chinese Office Action mailed Jul. 24, 2012 (with English translation).

Korean Office Action, Notice of Preliminary Rejection, Korean Patent Application No. 10-2010-7015923, dated May 31, 2012, with English Translation (6 pages).

* cited by examiner

100

SECTION A-A

UNIVERSAL DAMPING MECHANISM

CROSS REFERENCE TO RELATED APPLICATION

This application claims priority from U.S. Provisional Patent Application Ser. No. 61/022,579, filed on Jan. 22, 2008, the entirety of which is incorporated herein by reference.

FIELD OF THE INVENTION

The present invention relates generally to a universal damping mechanism for providing controlled movement of one part of a piece of furniture relative to another part thereof, more particularly, for damping the closure of a cabinet door or drawer relative to a cabinet housing or drawer housing, that can be universally installed in preexisting furniture containing drawers or cabinets with hinged doors.

BACKGROUND OF THE INVENTION

Many common pieces of furniture and other fixtures such as cabinets have drawers or at least one hinged door that allows access to an interior portion of the furniture or cabinet housing. Anyone can appreciate the sound of drawer or door "slap," which is produced when the drawer or door is allowed to close freely on the associated piece of furniture or cabinet housing, guided only by the closing force applied by the person along with the predetermined mechanics of the associated slide track (for drawers) or hinge assembly (for doors). Such "slap" is not only noisy, but over time can cause damage and wear to the drawers and doors, the associated furniture housing, and the respective sliding or hinging hardware.

It would be desirable to provide a damping mechanism that can be universally installed in preexisting furniture and cabinetry that would automatically slow the rate at which the drawer or door closes to provide a controlled closing rate that eliminates the occurrence of such "slap."

SUMMARY OF THE INVENTION

In accordance with present invention, a universal damping mechanism is provided for controlling the closure of a drawer or hinged door relative to its associated furniture or cabinet housing. The universal damping mechanism includes damping means fixed to the furniture or cabinet housing at a position sufficient to contact the drawer or door as it approaches the housing during the closing movement so as to dampen the closing movement of the drawer or door as it approaches its housing. Preferably, the position of the damping means is adjustable to change the amount of dampening effect asserted with respect to the drawer or door upon its closing.

In particular, the present invention provides a universal damping mechanism comprising a housing having a mounting surface for fixing to a surface of a furniture housing proximate a drawer or door opening thereof that is adapted to be closed off by an appropriate closing member (i.e., a drawer or door). The mounting surface of the housing comprises at least a portion of a bottom surface of a box-shaped portion of the housing. The box-shaped portion of the housing further includes a pair of laterally opposed side surfaces extending upwardly from the bottom surface of the box-shaped portion, and each of the lateral side surfaces of the box-shaped portion of the housing includes a recessed portion defining a first opening of an angled hole communicating with a second opening of the angled hole provided in the bottom surface of the box-shaped portion of the housing proximate a central portion of the bottom surface of the box-shaped portion of the housing. The universal damping mechanism also includes a shock absorber subassembly slidably positioned within a shock absorber receiving portion of the housing, and an adjustment mechanism coupled to the second end of the housing and adjustably engaged with a second end of the shock absorber subassembly within the shock absorber receiving portion of the housing.

Preferably, the housing further comprises a planar closure flap associated with each of the lateral side surfaces of the box-shaped portion of the housing, wherein a first end of each of the closure flaps is hingeably connected to a lower portion of a respective one of the lateral side surfaces of the box-shaped portion, and an opposed second end of each of the closure flaps is matably engaged with an outer portion of the shock absorber receiving portion of the housing, so that the closure flaps cover the recessed portions and the first openings of the angled holes in the lateral side surfaces of the box-shaped portion of the housing.

It is also preferred that the angled holes extend at an angle in a range of 60° to 65° with respect to the bottom surface of the box-shaped portion of the housing. As explained in more detail below, providing these specifically angled holes is critical with respect to enabling the universal damping mechanism according to the present invention to be universally mounted within tight tolerances in either the right or left hand corners of the desired furniture or cabinet housing.

According to another aspect of the present invention, a universal damping mechanism comprises a housing having a first end, a longitudinally opposed second end, a shock absorber receiving portion and a mounting surface for fixing the housing to an internal surface of a furniture or fixture opening that is closed off by a closing member such as a door or a drawer, and a shock absorber subassembly slidably situated in the shock absorber receiving portion of the housing so that a first end of the shock absorber subassembly is located in a first predetermined first position spaced a first distance away from the first end of the housing. An adjustment mechanism is coupled to the second end of the housing and adjustably engaged with a second end of the shock absorber subassembly within the shock absorber receiving portion of the housing to a degree sufficient to adjustably achieve the predetermined first position of the first end of the shock absorber subassembly. During a closing stroke of the closing member, such as a door or a drawer, a surface of the closing member contacts the first end of the shock absorber subassembly and exerts a closing force, which causes a portion of the shock absorber subassembly to slide into the shock absorber receiving portion of the housing at a rate that is less than an unimpeded closing rate, which dampens the force of the closing stroke until the closing member is closed, whereby the first end of the shock absorber subassembly is in contact with the closing member surface and assumes a second position spaced a second distance away from the first end of the housing, which is less than the first distance of the first position.

The second end of the housing preferably comprises a threaded section corresponding to a threaded shaft portion of the adjustment mechanism, so that when the adjustment mechanism is rotated, a longitudinal position of the shock absorber subassembly within the shock absorber receiving portion is changed, which correspondingly changes a distance between the first end of the shock absorber subassembly and the first end of the housing until the first distance is reached to adjustably establish the predetermined first position.

According to an aspect of the present invention, the shock absorber receiving portion of the housing comprises a cylindrical portion having a first end and a longitudinally opposed second end. In addition, the mounting surface of the housing comprises at least a portion of a bottom surface of a box-shaped portion of the housing that extends downwardly from the cylindrical portion. The box-shaped portion of the housing also has a front surface proximate the first end of the cylindrical portion, an opposed back surface, and a pair of laterally opposed side surfaces extending between the bottom surface of the box-shaped portion and the cylindrical portion. A flange extends from the bottom and lateral sides of the front surface, extending beyond the lateral side surfaces and the bottom surface of the box-shaped portion. It is preferred that the bottom surface of the box-shaped portion has a lateral dimension that does not exceed an outer diameter of the cylindrical portion.

Each of the lateral side surfaces of the box-shaped portion of the housing includes a recessed portion defining a first opening of angled hole communicating with a second opening of the angled hole provided in the bottom surface of the box-shaped portion of the housing. Preferably, the second opening of the angled holes is located proximate a central portion of the bottom surface of the box-shaped portion of the housing.

According to another aspect of the present invention, a planar closure flap is associated with each of the lateral side surfaces of the box-shaped portion of the housing. A first end of each of the closure flaps is hingeably connected to a lower portion of a respective one of the lateral side surfaces of the box-shaped portion, and an opposed second end of each of the closure flaps is matably engaged with at least one portion of the cylindrical portion of the housing, so that the closure flaps cover the recessed portions and the first openings of the angled holes in the lateral side surfaces of the box-shaped portion of the housing.

Preferably, the outer peripheral shape of at least a portion of the shock absorber subassembly corresponds to an internal space of the shock absorber receiving portion of the housing. According to one aspect, the internal space of the shock absorber receiving portion of the housing is substantially cylindrical and is defined by a substantially cylindrical inner surface. According to another aspect, the internal space of the shock absorber receiving portion has a polygon shape and is defined by a plurality of connected internal planar surfaces.

One of the main advantages of the universal damping mechanisms according to the present invention is the universal damping mechanisms provided hereby can be easily installed in pre-existing furniture or cabinet fixtures. There is no need to replace or relocate components of the furniture or existing cabinets, such as the hinge assemblies, to achieve the desired damping effect provided by the present invention. Another advantage is that the universal damping mechanism according to the present invention is, in fact, universal, in that it will work in connection with any type of closing member, such as a drawer/drawer housing or cabinet door/cabinet housing combination, regardless of the existing hinge assembly design. As such, the universal damping mechanism of the present invention can be used in connection with any type of furniture or cabinet assembly with minimal installation requirements.

BRIEF DESCRIPTION OF THE DRAWINGS

For a better understanding of the nature and objects of the invention, reference should be made to the following detailed description of a preferred mode of practicing the invention, read in connection with the accompanying drawings in which.

DETAILED DESCRIPTION OF THE INVENTION

Figure 1:
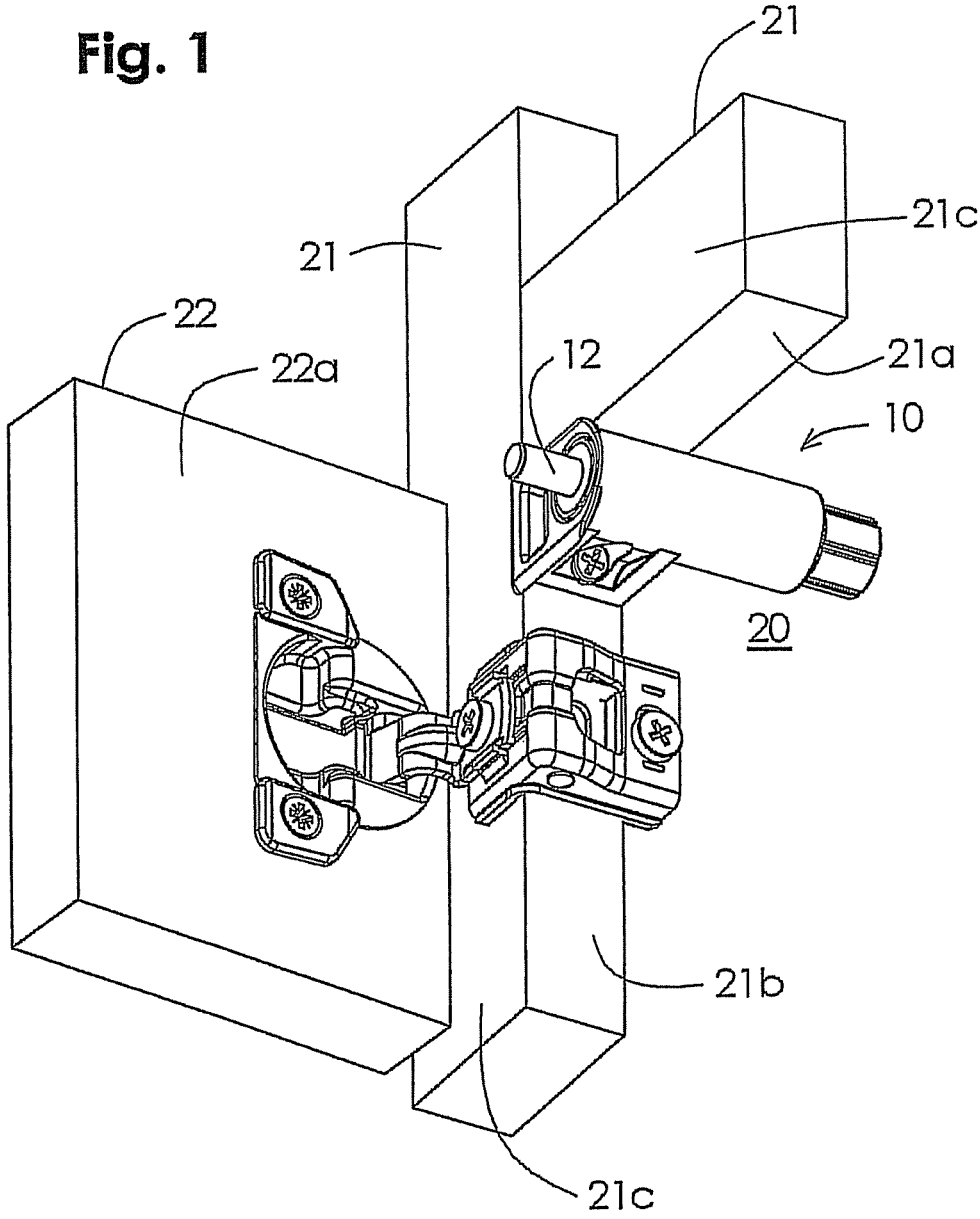
FIG. 1 is a perspective view of a universal damping mechanism 10 according to one embodiment of the present invention, as installed on a cabinet housing.

FIG. 1 shows a universal damping mechanism 10 in accordance with one embodiment of the present invention. As shown, the universal damping mechanism 10 is fixed, typically by at least one fixing mechanism, such as a screw, on an interior surface 21*b* of a door opening 20 framed by cabinet housing 21, which includes a hinged cabinet door 22 shown in an open position in FIG. 1. The universal damping mechanism 10 includes a shock absorber subassembly 11 including a plunger 12 that is positioned to contact a portion of the inner surface 22*a* of the cabinet door 22 as it approaches the cabinet housing 21 to close off access to the door opening 20. As the cabinet door 22 closes, it contacts the end of the plunger 12 and pushes the plunger 12 back into shock absorber 11 at a rate which is diminished from an ordinary closing rate determined by the hinge assembly, which in turn provides a damping effect to prevent cabinet door 22 from "slapping" against the front surfaces 21*c* of the cabinet housing 21.

Although it is not shown in the drawings, one skilled in the art should readily appreciate that the universal damping mechanisms according to the present invention described herein can also be fixed equally effectively on an interior surface of a drawer housing portion of a furniture item or a cabinet including drawers in a similar manner to that which is described above in connection with the drawings that specifically relate to a cabinet. In a like manner, the universal damping mechanisms according to the present invention effectively prevent drawer "slap" in the same manner door "slap" is prevented in conjunction with cabinets or hinged-door furniture, and allow for the controlled closing of a drawer. The following description is limited to an example of a cabinet door, however, it should be clearly understood that the present invention is not limited to drawer or cabinet door applications, and can also be used in conjunction with other closing members without departing from the scope or spirit of the present invention.

Figure 2:
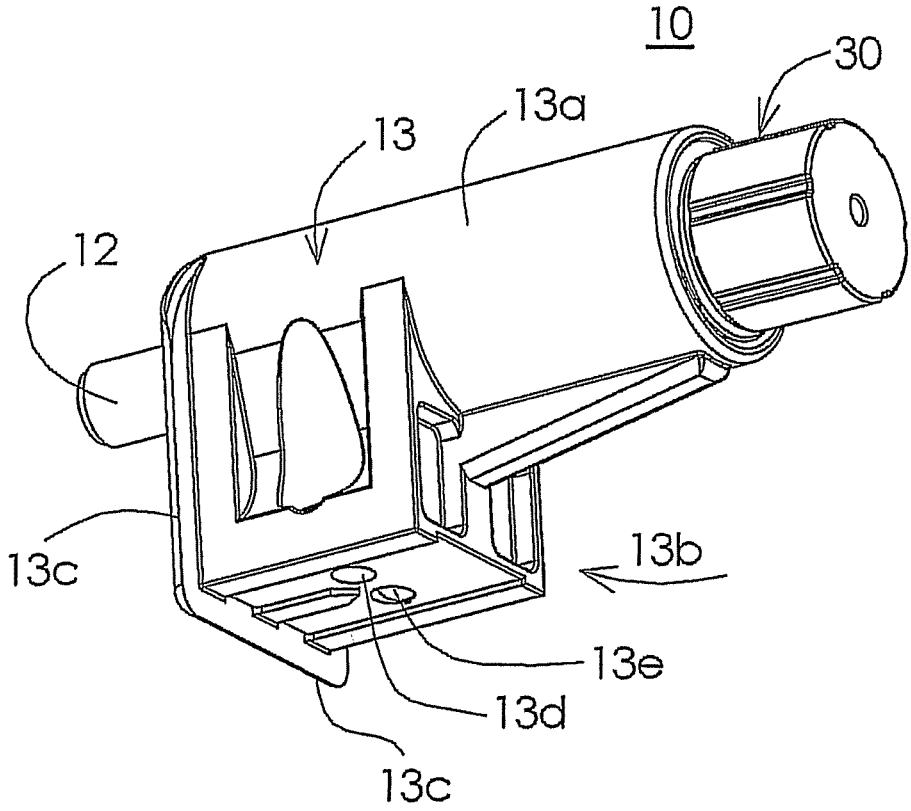
FIG. 2 is a right-facing perspective view of the universal damping mechanism 10 shown in FIG. 1.

FIG. 2 is a right-facing, rear perspective view of the universal damping assembly 10 shown in FIG. 1. The universal damping assembly 10 includes a housing 13 having a cylindrical portion 13*a* and a box-shaped portion 13*b*. The cylindrical portion 13*a* houses the shock absorber subassembly 11, as explained in more detail below, and the box-shaped portion 13*b* is configured to correspond to the shape of the interior surfaces 21*a*, 21*b* of the cabinet housing 21 that frames the door opening 20. The housing 13 also includes a flange 13*c* that extends at least along three sides of the front surface of the box-shaped portion 13*b*. The flange 13*c* engages the front surfaces 21*c* of the cabinet housing 21 that are substantially perpendicular to the interior surface 21*b* of the door opening 20 to ensure proper positioning of universal damping mechanism 10 relative to the door opening 20.

As shown in FIG. 1, the universal damping assembly 10 can be positioned in an upper interior corner of the cabinet housing 21 that frames the door opening 20, above the location of the hinge assembly on the interior surface 21*b* of the door opening 20, such that a bottom seating surface (e.g., the bottom surface of the box-shaped portion 13*b*) of the damping assembly is situated on the interior surface 21*b* of the door opening 20. In conjunction with the bottom surface, the flat lateral side surfaces of the box-shaped portion 13*b* and the flange 13*e* also help maintain the desired position of the universal damping assembly 10 while an installer affixes the universal damping mechanism 10 to the cabinet housing 21 by means of an attachment member, such as a screw or the like.

FIG. 2 also shows that two holes 13*d* and 13*e* for such attachment members are provided and inclined toward one another on opposite lateral side surfaces of the box-shaped portion 13*b*. Preferably, the holes 13*d* and 13*e* are inclined at an angle in a range of 60° to 65° with respect to the flat bottom surface of the box-shaped portion 13*b* of the housing 13. By virtue of these specifically angled holes 13*d*, 13*e*, access to the attachment members, such as screws, is easily achieved and the universal damping mechanism 10 can be readily installed either in the upper left-hand corner of the cabinet housing 21 framing the door opening 20 (as shown in FIG. 1), the lower left-hand corner (not shown), or the upper or lower right-hand corner of the cabinet housing 21 framing the door opening 20 (not shown). Such installation options would not be available without the specifically angled holes provided according to the present invention, which in fact further lend to the universal applicability of the damping structure of the present invention.

Figure 3:
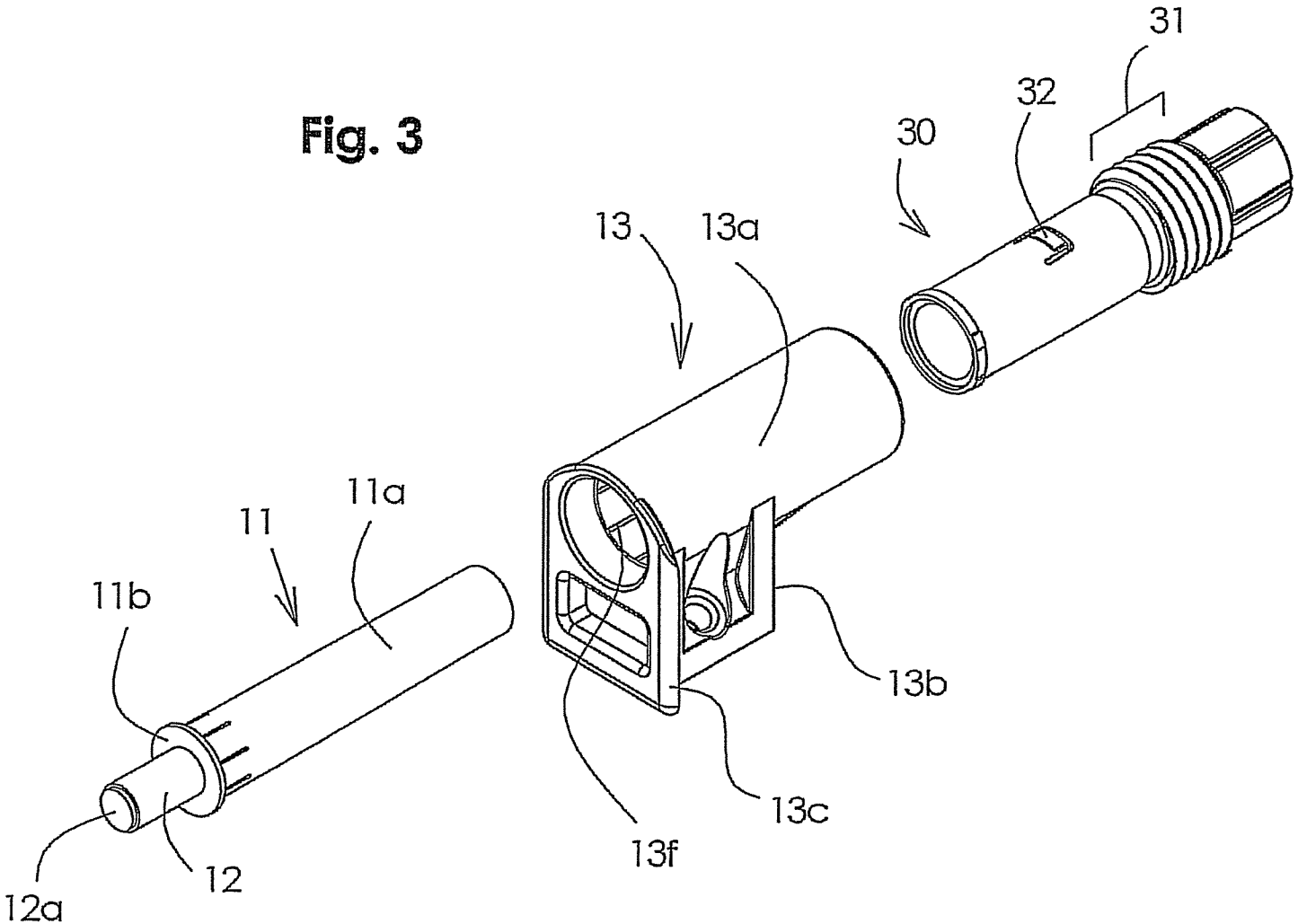
FIG. 3 is an exploded perspective view of the universal damping mechanism 10 shown in FIG. 1.

FIG. 3 is an exploded perspective view of the universal damping mechanism 10 shown in FIG. 1. FIG. 3 shows that the shock absorber 11 is generally cylindrical in shape. One example of a shock absorber suitable for use in the universal damping mechanism according to this aspect of the present invention is described in WO 2006/004237, the entirety of which is incorporated herein by reference.

The shock absorber 11 includes a main cylindrical section 11*a* and a flange 11*b* through which the plunger 12 extends. The main cylindrical section 11*a* is press-fit within a hollow adjustment barrel 30. In a compressed state, the shock absorber 11 is contained within the adjustment barrel 30 up to the point of flange 11*b*. The outer diameter of adjustment barrel 30 is sized such that it can be inserted into the cylindrical portion 13*a* of the housing 13.

The adjustment barrel 30 includes an external threaded portion 31 that engages corresponding internal threads (not shown) provided on an inner surface of the cylindrical portion 13*a* of the housing 13. This allows for adjustment of the portion of the terminal part 12*a* of the plunger 12 relative to the flange 13*c* of the housing 13. More specifically, the adjustment barrel 30 can be rotated in one direction to cause the terminal end 12*a* of the plunger 12 to extend further away from flange 13*c*, or rotated in the opposite direction to cause plunger 12 to reduce the distance between the terminal part 12*a* of the plunger 12 and the flange 13*c*. This adjustment is helpful in view of the fact that the inner door surfaces of different types of cabinet doors 22 are spaced at different distances with respect to the face of cabinet housings 21, usually due to different designs, for example.

This adjustment is also helpful in view of the fact that the force with which the cabinet door 22 attempts to contact the face 21*c* of the cabinet housing 21 varies not only with respect to the mechanics of the hinging assembly, but also with the size and material of the cabinet door. For example, the adjustment barrel 30 can be rotated to extend the terminal end 12*a* of the plunger 12 further away from the flange 13*c* of housing 13 if a greater damping force is necessary to accommodate greater closing forces associated with a larger/heavier door. Similarly, the adjustment barrel 30 can be rotated so that the terminal end 12*a* of the plunger 12 is closer to the flange 13*c* of the housing 13 when a lesser damping effect is needed for a smaller/lighter door.

The adjustment barrel 30 also includes a flexible, radially extending tab 32 that engages one of a plurality of longitudinally extending slots 131 formed along the inner surface of the cylindrical portion 13*a* of the housing 13. In this manner, as the adjustment barrel 30 is rotated, the tab 32 will temporarily engages each successive slot 13*f* and provides a means of resisting further rotation after the adjustment barrel 30 is rotated to its intended position. This prevents unintended rotation of the adjustment barrel 30 after installation that could otherwise be caused by vibrations from opening and closing the cabinet door, for example. Such unintended rotation would allow the position of the terminal end 12*a* of the plunger 12 to change, deviating from the initial damping setting chosen for the intended damping effect.

The housing 13 and the adjustment barrel 30 can be made of a variety of different materials, such as plastic and cast metal, provided the materials are of sufficient strength to enable the proper assembly and function of the various components of the universal damping mechanism 10, and to allow the box-shaped portion 13*b* of the housing 13 to be securely fastened to cabinet housing 21 by means of a screw, or the like.

Figure 4:
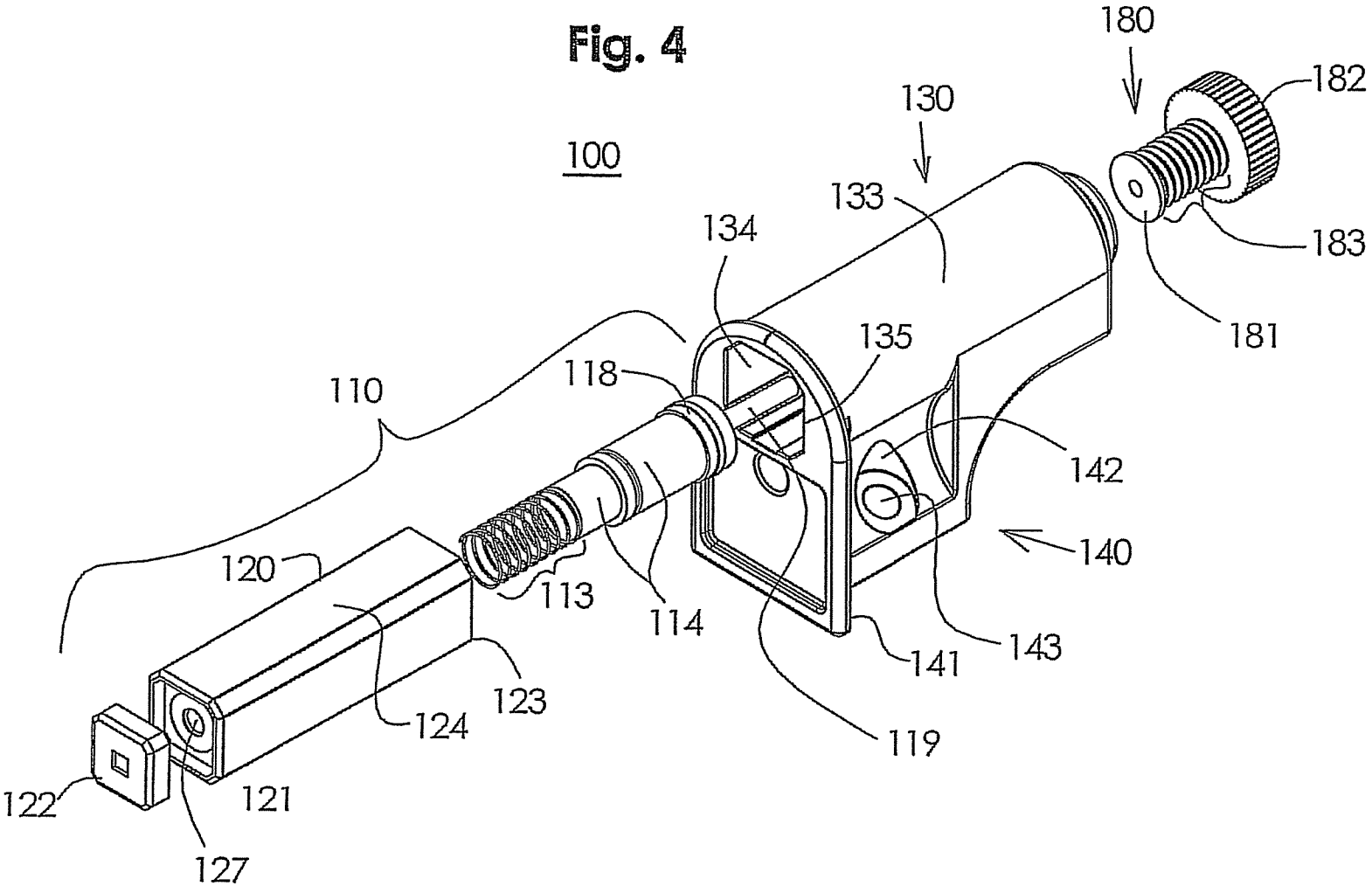
FIG. 4 is an exploded perspective view of a universal damping mechanism 100 according to another embodiment of the present invention.
Figure 5:
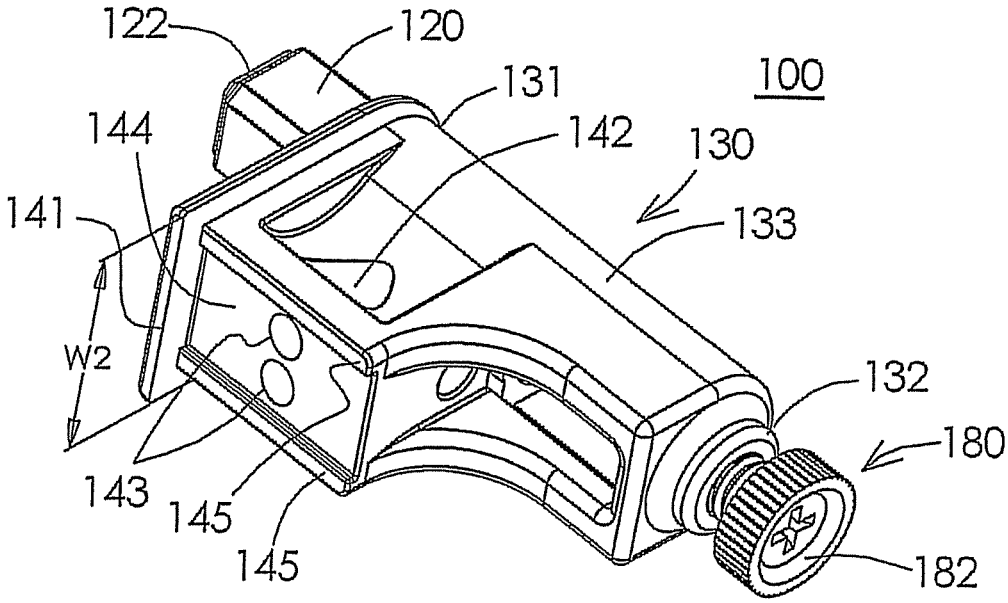
FIG. 5 is a bottom, right-side perspective view of the universal damping mechanism 100 shown in FIG. 4.
Figure 6:
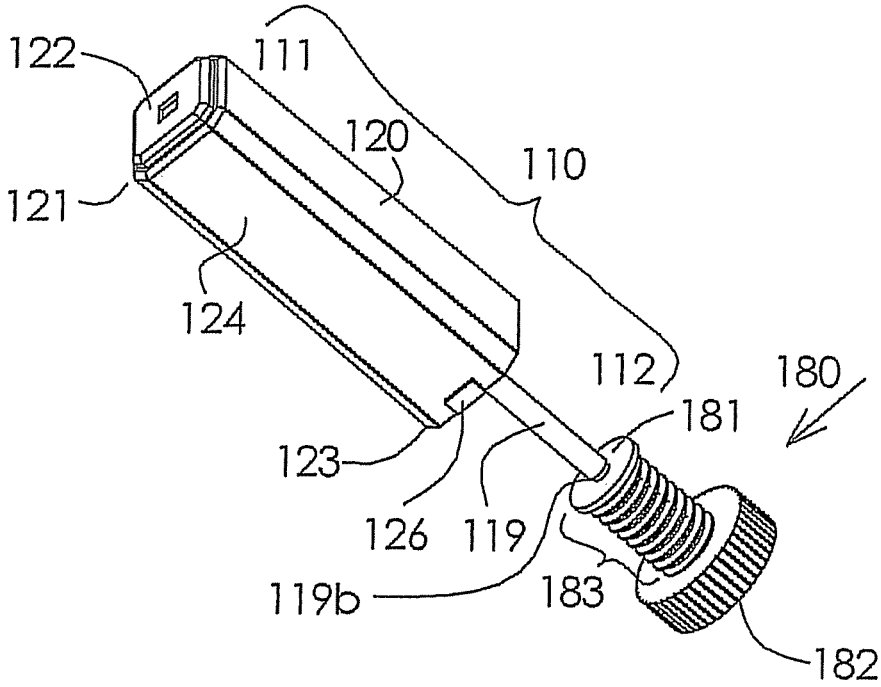
FIG. 6 is a perspective view of a shock absorber assembly 10 used in connection with the universal damping mechanism shown in FIG. 5.
Figure 7A:
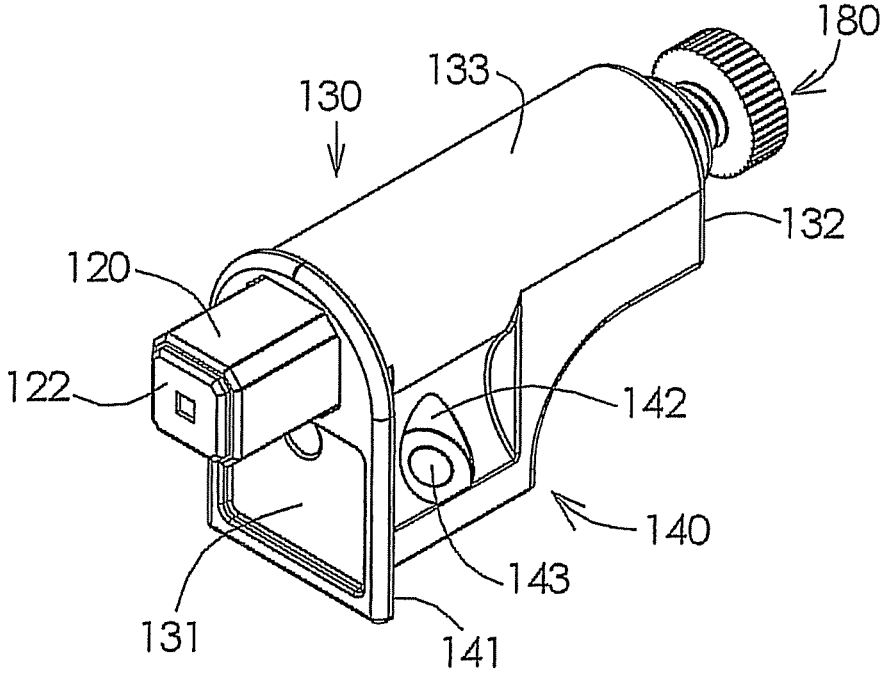
FIG. 7A is a left-facing, front perspective view
Figure 7B:
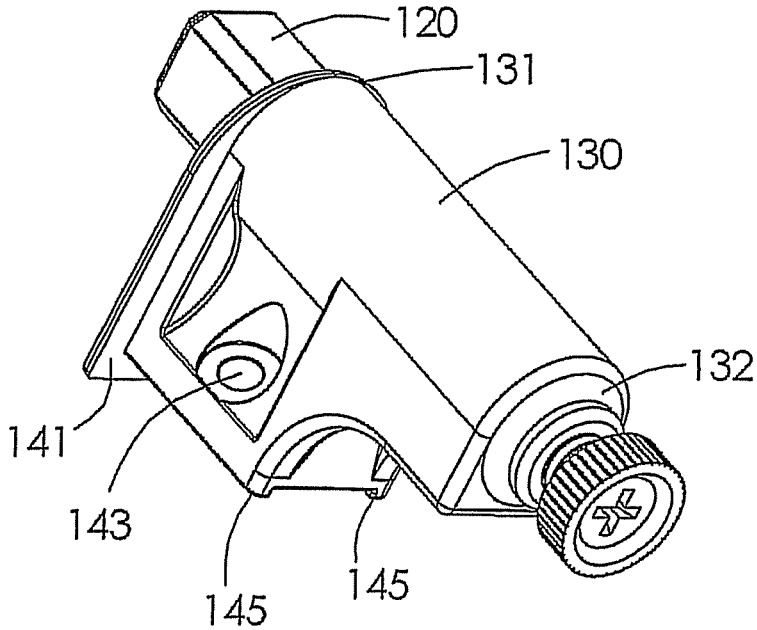
FIG. 7B is a left-facing, rear perspective view of the universal damping mechanism 100 shown in FIGS. 5 and 6.
Figure 8:
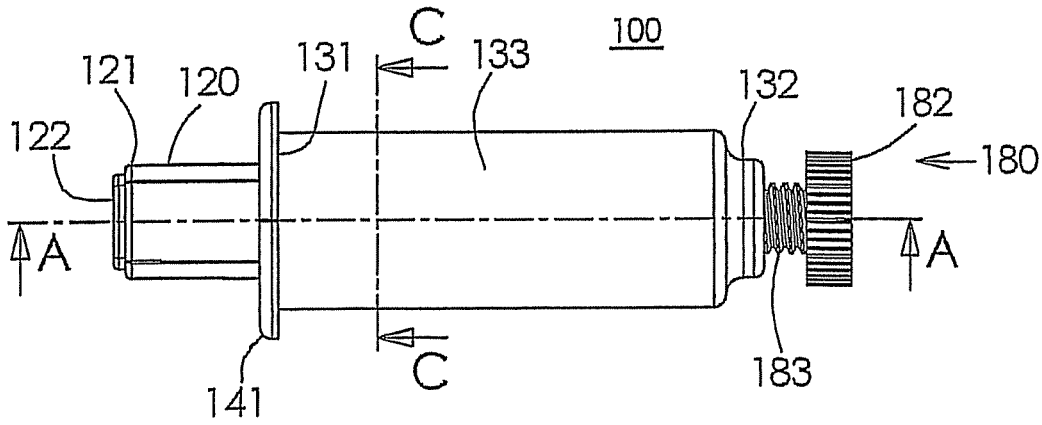
FIG. 8 is a top view of the universal damping mechanism 100 shown in FIGS. 5-7B.

FIG. 4 is an exploded perspective view of a universal damping mechanism 100 according to another embodiment of the present invention. FIG. 5 is a bottom, right-side perspective view of the universal damping mechanism 100 shown in FIG. 4, and FIG. 6 is a perspective view of the shock absorber assembly 110 used in connection with the universal damping mechanism 100 shown in FIGS. 4 and 5. FIG. 7A is a left-facing, front perspective view, FIG. 7B is a left-facing, rear perspective view and FIG. 8 is a top view of the universal damping mechanism 100 shown in FIGS. 5 and 6.

The universal damping mechanism 100 includes a shock absorber subassembly 110 that is slidably situated within a housing 130 and whose extension therefrom is adjusted via the adjustment mechanism 180 to account for the differing degree of damping required for a particular cabinet door, in a similar manner to that described above in connection with the adjustment barrels of FIGS. 1-3.

The housing 130 shown in FIGS. 4, 5 and 7A, 7B-10, which is similar to the housing 13 described above in connection with FIGS. 1-3 (the corresponding reference numerals of which are included in parentheses as follows) includes a cylindrical portion 133 (13*a*) and a box-shaped portion 140 (13*b*) having a bottom surface 144 (shown but not numbered in FIGS. 1-3), a flange 141 (13*c*), laterally positioned recesses 142 (shown but not numbered in FIGS. 1-3) provided in the planar lateral side surfaces of the box-shaped portion 140 for accessing the angled holes 143 (13*d*, 13*e*) through which attachment members (not shown) are inserted to secure the housing 130 to a surface of the cabinet housing 21 that frames the door opening 20, and stability/positioning ridges 145 (shown but not numbered in FIGS. 1-3) provided on the bottom surface 144.

In order to provide a damping mechanism that is universally applicable with respect to any existing cabinet and furniture door, it is important for the universal damping mechanism to fit within the preexisting structural constraints of a given cabinet/furniture door and its associated hardware and housing or door frame. In some instances, the door hinge assemblies are located very close to the top and/or bottom of the cabinet door, and thus close to the upper and/or lower corners of the cabinet housing that frames the door opening. This situation leaves little room for the installation of any additional hardware in a position that will not otherwise interfere, with gaining access to the space within the cabinet through the door opening. The same applies with respect to placement in situations with drawer housings.

Providing the smallest possible width for the overall footprint of the universal damping mechanisms, with respect to the surface of the cabinet or drawer housing on which the universal damping mechanism is mounted, allows the universal damping mechanisms according to the present invention to be positioned at or near either of the upper/lower portions of either of the left/right corners of the cabinet or drawer housing that frames the respective opening as desired, even in instances where the preexisting hinge assemblies are installed near the top/bottom of the doors, for example. Moreover, the provision of the dual angled holes 143 (13*d*, 13*c*) enables the damping mechanisms according to the present invention to be universally installed on either the left or right hand side of the cabinet housing that frames the door opening, as required for any given situation. Preferably, the holes 143 are inclined toward one another at an angle in a range of 60° to 65° with respect to the flat bottom surface 144 of the box-shaped housing 140.

Figure 10:
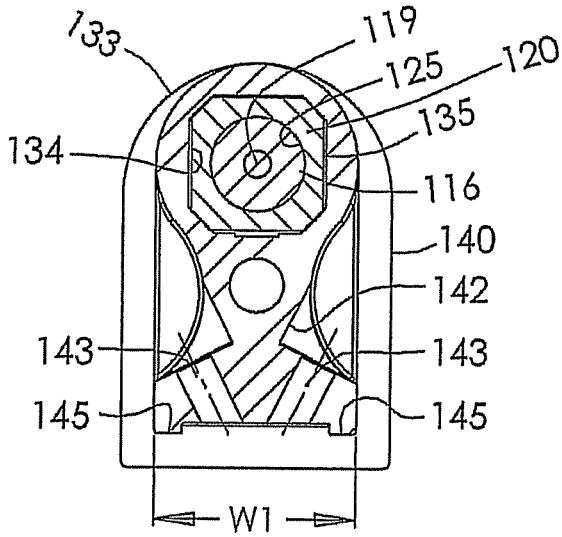
FIG. 10 is a cross-sectional view taken through line C-C in FIG. 8.

The width $W_1$ of the bottom surface 144 of the box-shaped portion 140 is defined between the outermost edges of the laterally opposed stability/positioning ridges 145, which contact the mounting surface of the drawer or cabinet housing and provide a stable seat for the box-shaped portion 140 of the housing 130 (see, e.g., FIG. 10). The width $W_2$ of the flange 141 defines the overall width of the footprint of the universal damping mechanism 100 with respect to the mounting surface of the cabinet housing (see, e.g., FIGS. 2, 4 and 5). This feature is common to all of the embodiments of the present invention so that any of the universal damping mechanisms according to the present invention can be properly positioned and easily installed even when the door hinge assembly is located close to the top of the door and its associated opening in the cabinet housing. As described above in connection with FIGS. 1-3, the bottom and at least one lateral side surface of the flange 141 engage the faces 21*c* of the cabinet housing 21 framing the door opening 20 to provide stability and assist with proper positioning during installation.

Although it is not shown in the drawings, it should be understood that the installation orientation of the universal damping mechanisms according to the present invention is not limited to that shown in FIG. 1. That is, the orientation could be rotated 90 degrees so that the bottom surface 144 of the box-shaped portion 140 of the housing 130 would instead contact the horizontal upper surface 21*a* of the cabinet housing 21 framing the door opening 20, instead of the vertical side surface 21*b* thereof. The installation orientation can be adjusted as needed for drawer housing installation situations, as well.

As shown in FIGS. 4 and 10, for example, the shape of the inner surface 134 of the cylindrical portion 133 of the housing 130 is not cylindrical, but is instead polygonal, defining a polygon shaped inner space that substantially corresponds to the outer peripheral shape of the plunger shaft 120 of the shock absorber subassembly 110, which is described in more detail below. The polygon shaped inner space defined by the inner surface 134 of the housing 130 is dimensioned to closely correspond to the outer dimensions of the plunger shaft 120 of the shock absorber subassembly 110, while providing sufficient clearance so that the shock absorber subassembly 110 both correctly engages and slidably moves within the inner space of the housing 130 as intended (see, e.g. FIG. 9).

Figure 9:
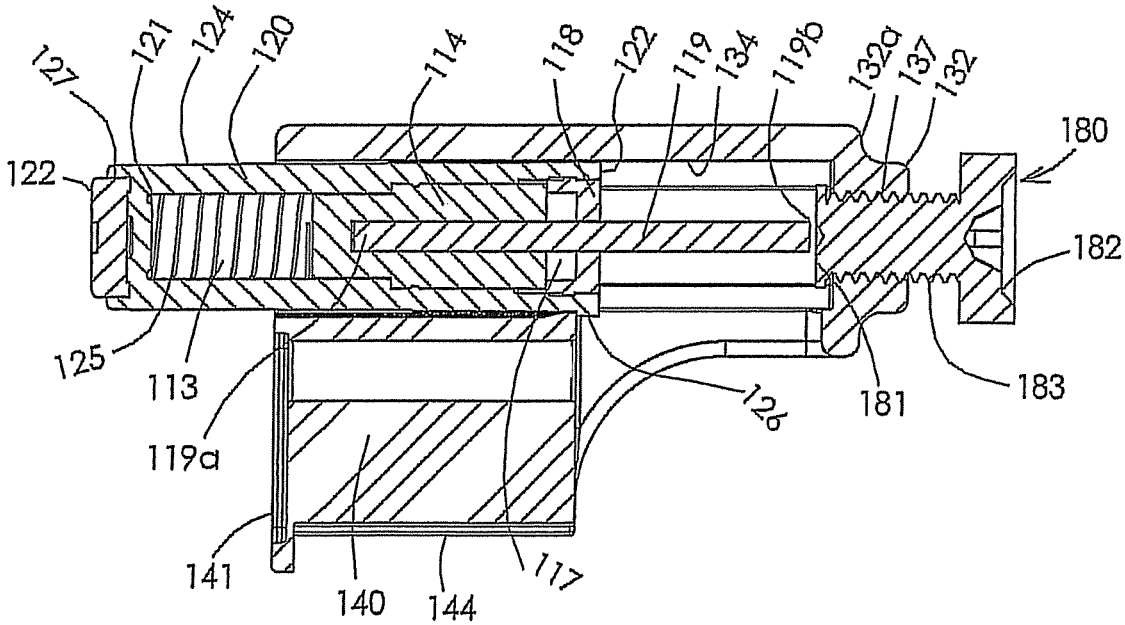
FIG. 9 is a cross-sectional view taken through line A-A in FIG. 8.

FIG. 10 also shows that the opening 135 at the first end 131 of the housing 130 is shaped to accommodate insertion and slidable movement of the shock absorber subassembly 110 therein. As shown in FIG. 9, the second end 132 of the housing 130 has a different shape, including an inner annular flange or step portion 132*a* which, if necessary, can serve as a stopper for the movement of shock absorber subassembly, specifically the second end 123 of the plunger shaft 120, as described below. The opening 137 at the second end 132 of the housing 130 is provided with a threaded portion adapted to accommodate and engage the adjustment mechanism 180.

As noted above, and as shown in FIGS. 4, 6 and 9, for example, the shock absorber subassembly 110 includes a plunger shaft 120 having a terminal end 122, which is located at a first end 121 of the plunger shaft 120, and which together define a first end 111 of the shock absorber subassembly 110. The plunger shaft 120 extends in a longitudinal axis direction of the housing 130 from the first end 121 thereof toward an opposed second end 123 thereof, which is situated within the inner space of the housing 130.

As shown, the outer surface 124 of the plunger shaft 120 has a polygon shape substantially corresponding to the shape of a square with truncated, angled corners. Providing a substantially square-shaped shock absorber subassembly 110, as opposed to the cylindrical shock absorber subassembly 11 shown in FIG. 1, increases the ability of the shock absorber subassembly to resist rotation within the housing and enables the shock absorber subassembly to better retain its intended position. It should also be noted that the shape of the shock absorber is not limited to the embodiments shown herein, and the shock absorber can have any shape so long as the shape correctly cooperates with the inner space of its associated housing.

The inner surface 125 of the plunger shaft 120 defines a substantially cylindrical inner space 128 that houses other components of the shock absorber subassembly 110. For example, the shock absorber subassembly 110 comprises a bias member or spring 113, which, once assembled with the plunger shaft 120, is positioned proximate the first end 121 of the plunger shaft 120 within the cylindrical inner space 128 (see, e.g., FIG. 9). A damping structure 114 is located between the bras member or spring 113 and an end cap 118. Portions of the damping structure 114 can be provided with holes (not shown) that are sized and numbed to sufficiently create the desired level of damping with respect to controlling the flow of a damping fluid within the shock absorber subassembly 110.

For example, the damping structure 114 can be or include a sponge member portion, which is provided to aid in the elimination of any bubbles that might be present in the damping fluid within the shock absorber subassembly 110, which can be located, for example, between the spring 113 and one or more sealing members (see, e.g., sealing member 117 shown in FIG. 9), which, in conjunction with the end cap 118, function to contain the damping fluid within the shock absorber subassembly 110.

The shock absorber sub assembly 110 also includes a rod 119. The first end 119*a* of the rod 119 is fixedly positioned with respect to the damping structure 114 within the inner space 128 of the plunger shaft 120, and the opposed second end 119*b* of the rod 119, which corresponds to a second end 112 of the shock absorber subassembly 110, extends a distance beyond the second end 123 of the plunger shaft 120. The rod 119 is positioned to substantially coincide with a central axis of the plunger shaft 120, and passes through openings in the damping structure 114, the sealing member 117 and the end cap 118. The second end 119*b* of the rod 119 is positioned to either directly contact, or be positioned immediately proximate the first end 181 of the adjustment mechanism 180, as shown in FIG. 9. In that manner, the rod 119 remains a substantially if not completely stationary component of the shock absorber subassembly 110. The relationship between the diameter of the rod 119 and the diameter of the openings in the end cap 118, the sealing member 117 and the damping structure 114 is such that a small clearance is provided, so that the rest of the shock absorber subassembly 110 can move relative to the housing 130 and the substantially stationary rod 119.

Rotating the second end 182 of the adjustment mechanism 180 causes the first end 181 to be rotatably inserted into (or rotated out of) the threaded opening 137 along its threaded shaft 183. The first position of the first end of the shock absorber subassembly 110, more specifically the terminal end 122 of the plunger shaft 120 at the first end 111 of the shock absorber assembly 110, is determined by the degree to which the second end 182 of the adjustment mechanism 180 is rotated. That is, as the second end 182 of the adjustment mechanism 180 is rotated, the first end 181 of the adjustment mechanism 180 engages the second end 119*b* of the rod 119, and pushes the rod 119, and thus the entire shock absorber subassembly 110, further beyond the first end 131 of the housing 130. Since the second end 119*b* of the rod 119 remains engaged with the first end 181 of the adjustment mechanism 180, subsequent movement of the entire shock absorber subassembly 110 toward the second end 132 of the housing 130 is limited so that the terminal end 122 of the plunger shaft 120 is adjustably set in its predetermined first position. In that manner, only the portions of the shock absorber subassembly 110 that are designated to move, relative to the housing 130 and the rod 119, back toward the second end 132 of the housing 130 during a door closing stroke to effectuate the damping function can do so.

The adjustment/determination of the first distance between the terminal end 122 of the plunger shaft 120 of the shock absorber subassembly 110 and the first end 131 of the housing 130, which corresponds to the first position of the first end 111 of the shock absorber subassembly 110, can be made by rotating the adjustment mechanism 180 as needed to account for different damping speeds and different sized/weighted cabinets doors, as described above in connection with FIGS. 1-3.

When the cabinet door 22 is open, the terminal end 122 of the plunger shaft 120 at the first end 111 of the shock absorber subassembly 110 is in the first position, as shown, for example, in FIGS. 5, 7A, 7B and 9. A closing stroke, e.g., in the direction toward the housing 130 applies force to the terminal end 122 of the plunger shaft 120 and causes the bias member or spring 113 to compress, which it resists by virtue of its bias, and which aids in damping the force of the stroke. The compression of the bias member 113 as the plunger shaft 120 moves into the housing 130 causes damping fluid present in the shock absorber subassembly 110 to flow at a controlled rate toward the second end 123 of the plunger shaft 120 through the damping structure 114, and any bubbles which may be present in the damping fluid are removed via the sponge member portion thereof. The speed at which the plunger shaft 120 slides into the housing member 130 is therefore controlled, and as a result, controls the speed at which the door surface approaches the faces 21*c* of the cabinet housing to dampen the overall force of the door's closing stroke.

When the door is finally closed, without any "door slap," the terminal end 122 of the plunger shaft 120 of the shock absorber subassembly 110 then occupies a second position, in contact with the surface of the door, whereby a constant force is applied to the terminal end 122 of the plunger shaft 120. The second position of the terminal end 122 of the plunger shaft 120 is spaced a second distance from the first end 131 of the housing 130, which is less than the first distance at the first position. As that force is released by a door (or drawer, for example) opening stroke, the compressed bias member or spring 113 of the shock absorber subassembly 110 becomes uncompressed, and damping fluid moves back toward the first end 121 of the plunger shaft 120, and the plunger shaft 120 moves outwardly with respect to the housing member 130 so that the terminal end 122 of the plunger shaft 120 extends further away from the flange 141 as it again assumes its predetermined first position at the first distance away from the first end 131 of the housing 130.

As shown in FIGS. 6 and 9, the outer surface 124 of the plunger shaft 120 also includes an engagement tab 126 extending outwardly proximate the second end 123 thereof. This engagement tab 126 engages a portion of the inner surface 134 of the housing 130 and acts as a stopper to prevent the plunger shaft 120 from moving past the first position to assume another position whereby the terminal end 122 of the plunger shaft 120 would be located even farther away from the housing 130.

Figure 11A:
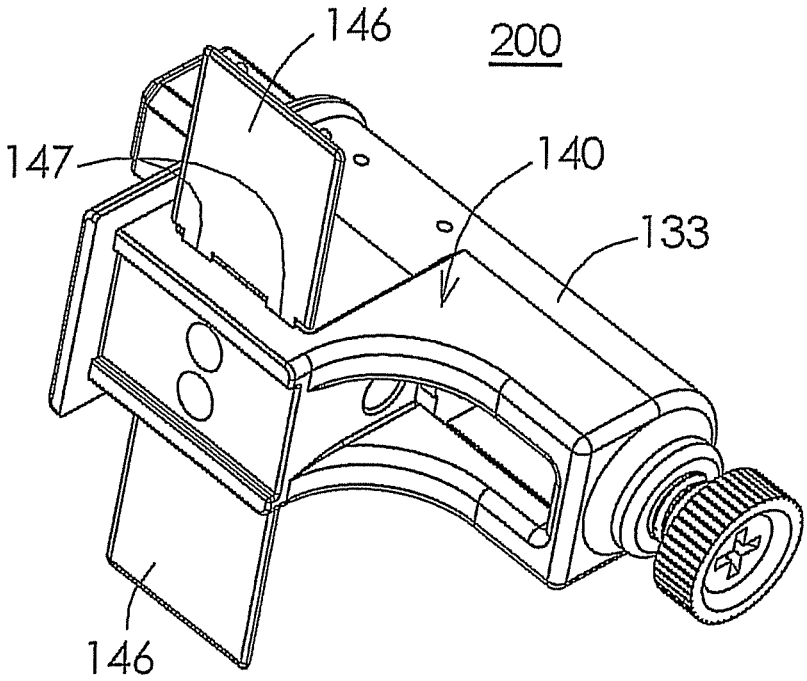
FIGS. 11A-11C are perspective views of a universal damping mechanism 200 according to another aspect of the present invention.
Figure 11B:
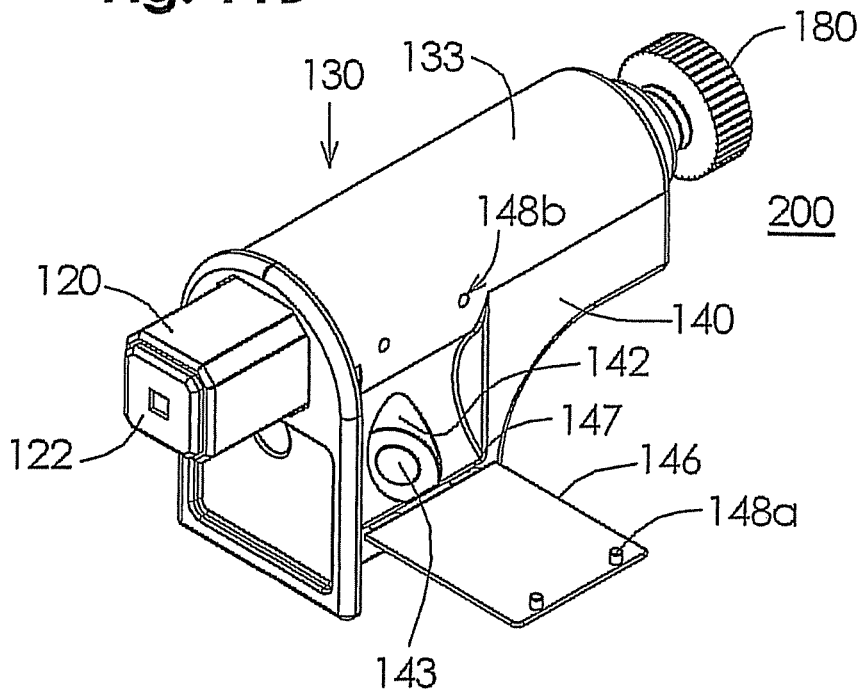
Figure 11C:
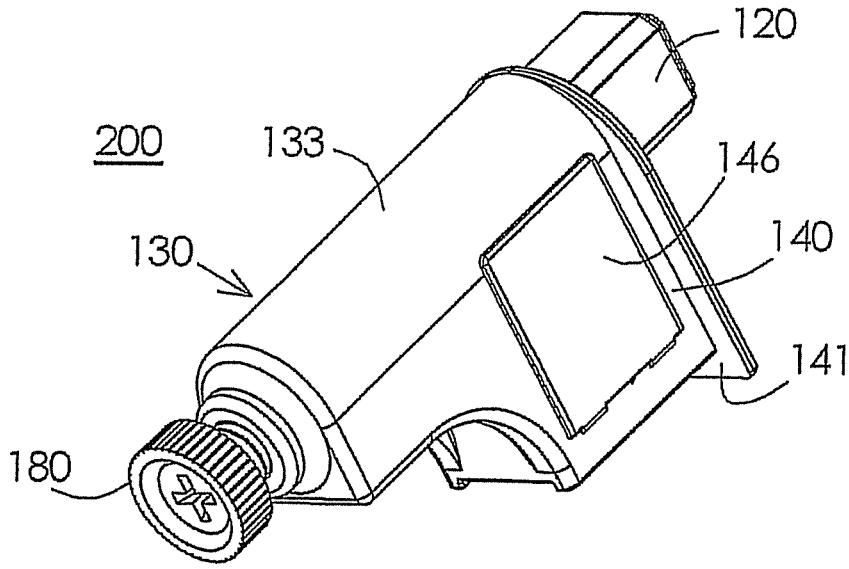

FIGS. 11A-11C are perspective views of a universal damping mechanism 200 according to another embodiment of the present invention. In this case, the housing 130 is provided with a pair of closure flaps 146 that cover the recesses 142 and the angled holes 143 on each of the lateral side surfaces of the box-shaped portion 140 of the housing 130, so that the lateral side surfaces of the box-shaped portion 140 exhibit a flat profile, as shown in FIG. 11C, rather than a recessed profile, as shown in FIG. 10. FIGS. 11A and 11B show the closure flaps 146 in an open position, and FIG. 11C shows the closure flaps 146 in the closed portion. One end of each closure flap 146 is hingeably connected to a lower portion of a lateral side surface of the box-shaped portion 140 of the housing 130 via hinge members 147. The upper, inner surface of other end of each closure flap 146 includes a pair of mating tabs 148*a* that correspondingly engage the mating members 148*b* provided on an outer portion of the housing, for example, a lower lateral portion the cylindrical portion 133 of the housing 130. In this manner, the closure flaps 146 can be easily opened, when access to the holes 143 is desired, and then securely closed thereafter.

When the closure flaps 146 are open, an installer can access the recesses 142 and angled holes 143 in order to install or remove an attachment member, such as a screw, during installation or removal of the universal damping mechanism 200. When the closure flap 146 is closed, the mating tabs 148*a* engage the mating members 148, such as recesses or slots dimensioned to receive and retain the mating members 148*a*, and the recesses 142 and holes 143 are covered and no longer accessible. It should be noted, however, that instead of the hinge members 147 and the mating tabs 148*a*/148*b* shown in FIGS. 11A-11C, the closure flaps 146 could be attached to the housing 130 using any other suitable connection member that allows access to the recessed portions 142 and the angled holes 143 as needed, and which can then be securely fastened in a closed position. The closure flaps 146 and hinge members 147 are preferably made from the same material as that of the housing, but can also be made of any other compatible material. Aside from the aesthetic benefits, the closure flaps 146 also aid in maintaining the properly aligned position when the damping structure is mounted and during use.

While the present invention has been particularly shown and described with reference to the preferred mode as illustrated in the drawings, it will be understood by one skilled in the art that various changes in detail may be effected therein without departing from the spirit and scope of the invention as defined by the claims.

What is claimed:

1. A universal damping mechanism comprising:

a housing having a mounting surface for fixing the housing to a surface of a furniture proximate an opening thereof that is adapted to be closed off by a closing member, wherein said mounting surface of said housing comprises at least a portion of a bottom surface of a box-shaped portion of said housing, said box-shaped portion of said housing further including a pair of laterally opposed side surfaces extending upwardly from said bottom surface of said box-shaped portion, each of said lateral side surfaces of said box-shaped portion of said housing including a recessed portion defining a first opening of an angled hole communicating with a second opening of said angled hole provided in said bottom surface of said box-shaped portion of said housing proximate a central portion of said bottom surface of said box-shaped portion of said housing;

a shock absorber subassembly slidably positioned within a shock absorber receiving portion of said housing and having a first end extending from a first end of said housing; and an adjustment mechanism coupled to a second end of said housing and adjustably engaged with a second end of said shock absorber subassembly within said shock absorber receiving portion of said housing.

2. The universal damping mechanism according to claim 1, further comprising a planar closure flap associated with each of said lateral side surfaces of said box-shaped portion of said housing, wherein a first end of each of said closure flaps is hingeably connected to a lower portion of a respective one of said lateral side surfaces of said box-shaped portion, and wherein an opposed second end of each of said closure flaps is matably engaged with an outer portion of said shock absorber receiving portion of said housing, so that said closure flaps cover said recessed portions and said first openings of said angled holes in said lateral side surfaces of said box-shaped portion of said housing.

3. The universal damping mechanism according to claim 1, wherein said box-shaped portion of said housing extends from said shock absorber receiving portion of said housing.

4. The universal damping mechanism according to claim 3, wherein said bottom surface of said box-shaped portion has a lateral dimension that does not exceed an outer dimension of said shock absorber receiving portion of said housing.

5. The universal damping mechanism according to claim 1, wherein said angled holes extend at an angle in a range of 60° to 65° with respect to said bottom surface of said box-shaped portion of said housing.

6. The universal damping mechanism according to claim 1, wherein an outer peripheral shape of at least a portion of said shock absorber subassembly corresponds to an internal space of said shock absorber receiving portion of said housing.

7. The universal damping mechanism according to claim 1, wherein said mounting surface fixes said housing directly to said surface of said furniture.

8. A universal damping mechanism comprising:

a housing having a first end, a longitudinally opposed second end, a cylindrical portion defining a portion of the outer peripheral shape of the housing and defining a shock absorber receiving portion, and a box-shaped portion, extending downwardly from said cylindrical portion and defining a mounting surface for fixing the housing to a surface of a furniture proximate an opening thereof that is adapted to be closed off by a closing member;

a shock absorber subassembly slidably positioned in said shock absorber receiving portion of said housing so that a first end of said shock absorber assembly is located in a predetermined first position spaced a first distance away from said first end of said housing; and an adjustment mechanism coupled to said second end of said housing and adjustably engaged with a second end of said shock absorber subassembly within said shock absorber receiving portion of said housing to a degree sufficient to adjustably achieve said predetermined first position of said first end of said shock absorber subassembly;

wherein during a closing stroke of the closing member, a surface of the closing member contacts said first end of said shock absorber subassembly and exerts a closing force, which causes a portion of said shock absorber subassembly to slide into said shock absorber receiving portion of said housing at a rate that is less than an unimpeded closing rate of said closing member so as to dampen the force of the closing stroke until the closing member is closed, whereby said first end of said shock absorber subassembly is in contact with the surface of the closing member and assumes a second position spaced a second distance away from said first end of said housing, which is less than said first distance of said first position.

9. The universal damping mechanism according to claim 8, wherein in said shock absorber receiving portion of said housing, said cylindrical portion has a first end and a longitudinally opposed second end; and wherein said mounting surface of said housing comprises at least a portion of a bottom surface of the box-shaped portion of said housing that extends downwardly from said cylindrical portion, said box-shaped portion of said housing further including a front surface proximate said first end of said cylindrical portion, an opposed back surface, and a pair of laterally opposed side surfaces extending between said bottom surface of said box-shaped portion and said cylindrical portion.

10. The universal damping mechanism according to claim 9, wherein said bottom surface of said box-shaped portion has a lateral dimension that does not exceed an outer diameter of said cylindrical portion.

11. The universal damping mechanism according to claim 9, wherein each of said lateral side surfaces of said box-shaped portion of said housing includes a recessed portion defining a first opening of an angled hole communicating with a second opening of said angled hole provided in said bottom surface of said box-shaped portion of said housing.

12. The universal damping mechanism according to claim 11, wherein said second opening of said angled hole is located proximate a central portion of said bottom surface of said box-shaped portion of said housing.

13. The universal damping mechanism according to claim 11, wherein said angled holes extend at an angle in a range of 60° to 65° with respect to said bottom surface of said box-shaped portion of said housing.

14. The universal damping mechanism according to claim 11, further comprising a planar closure flap associated with each of said lateral side surfaces of said box-shaped portion of said housing, wherein a first end of each of said closure flaps is hingeably connected to a lower portion of a respective one of said lateral side surfaces of said box-shaped portion, and wherein an opposed second end of each of said closure flaps is matably engaged with at least one portion of said cylindrical portion of said housing, so that said closure flaps cover said recessed portions and said first openings of said angled holes in said lateral side surfaces of said box-shaped portion of said housing.

15. The universal damping mechanism according to claim 11, wherein said mounting surface fixes said housing directly to said surface of said furniture.

16. The universal damping mechanism according to claim 8, wherein an outer peripheral shape of at least a portion of said shock absorber subassembly corresponds to an internal space of said shock absorber receiving portion of said housing.

17. The universal damping mechanism according to claim 16, wherein said internal space of said shock absorber receiving portion of said housing is substantially cylindrical and is defined by a substantially cylindrical inner surface.

18. The universal damping mechanism according to claim 16, wherein said internal space of said shock absorber receiving portion has a polygon shape and is defined by a plurality of internal connected planar surfaces.

19. The universal damping mechanism according to claim 8, wherein said second end of said housing comprises a threaded section corresponding to a threaded shaft portion of said adjustment mechanism, so that when said adjustment mechanism is rotated, a longitudinal position of said shock absorber subassembly within said shock absorber receiving portion is changed, which correspondingly changes a distance between said first end of said shock absorber subassembly and said first end of said housing until said first distance is reached to adjustably establish said predetermined first position.

20. The universal damping mechanism according to claim 8, wherein said mounting surface fixes said housing directly to said surface of said furniture.

* * * * *